United States Patent [19]

Babcock

[11] Patent Number: 4,491,999

[45] Date of Patent: Jan. 8, 1985

[54] BUFFING PAD RETAINER

[76] Inventor: Ernest R. Babcock, 257 Lafayette, Ionia, Mich. 48846

[21] Appl. No.: 399,470

[22] Filed: Jul. 19, 1982

[51] Int. Cl.[3] ..... B24B 29/00; A47L 11/14

[52] U.S. Cl. ..... 15/230; 15/98; 15/257 R

[58] Field of Search ..... 15/257 R, 230, 246, 15/98; 51/380, 358, 170 T, 177

[56] References Cited

U.S. PATENT DOCUMENTS

| | | | |
|---|---|---|---|
| 656,283 | 8/1900 | Edwards | 15/230 X |
| 1,675,078 | 6/1928 | Yutzler | 15/98 |
| 1,778,470 | 10/1930 | Stratford . | |
| 1,988,193 | 1/1935 | Edström . | |
| 3,047,897 | 8/1962 | Bartos et al. | 15/114 |
| 3,462,889 | 8/1969 | Erickson | 51/380 |

FOREIGN PATENT DOCUMENTS

| | | | |
|---|---|---|---|
| 395451 | 12/1965 | Switzerland | 15/230 |

*Primary Examiner*—Edward L. Roberts
*Attorney, Agent, or Firm*—John A. Waters

[57] ABSTRACT

A buffing pad retainer is provided for retaining an annular buffing pad in operable engagement with the bristles of a rotating annular floor machine brush. The retainer is a truncated conical disk having a depending cylindrical coaxial disk portion. In operation, the conical disk fits in the bore of the annular rotating brush, while the depending cylindrical coaxial disk fits in the bore of the annular buffing pad.

4 Claims, 4 Drawing Figures

BUFFING PAD RETAINER

BACKGROUND OF THE INVENTION

1. Field of the Invention

This invention relates to floor machines, and, more particularly, to a buffing pad retainer for retaining an annular buffing pad in operable engagement with the bristles of a rotating annular floor machine brush.

2. Description of the Prior Art

Motorized rotating floor machines have been in use for many years. These machines are used for scrubbing, polishing and finishing floors of all kinds. Typically, a rotating annular brush is used for scrubbing and cleaning the floor. After the floor has been cleaned, a floor finish or wax is applied, followed by a buffing or polishing operation. For the most effective polishing or finishing operation, a texturized buffing pad is employed, generally by interposing the pad between the brush bristles and the floor surface.

Although a wide variety of means for maintaining the buffing pads in operable engagement with the rotating brush have been employed, none has been entirely satisfactory. For example, some users merely rely on the weight of the floor machine and the friction between the brush bristles and the buffing pad to keep the pad in operable engagement with the brush. However, more often than not, the friction is insufficient to maintain the engagement, and the buffing pad is propelled a significant distance from the machine with obvious inconvenience and safety problems. Other means employ a variety of mechanical attachments which positively attach the buffing pad to the brush head. Still others permanently attach the buffing pad to a retainer by nails or staples and the retainer is then installed in the brush. Although these means generally provide a satisfactory connection, they are expensive, cumbersome and/or time consuming to utilize.

Accordingly, there is a present need for a buffing pad retainer which will maintain an annular buffing pad in operable engagement with the bristles of a rotating annular floor machine brush which is inexpensive, simple and easy to use.

SUMMARY OF THE INVENTION

According to the present invention, there is provided a buffing pad retainer for retaining an annular buffing pad in operable engagement with the bristles of a rotating annular floor machine brush. The buffing pad retainer requires no mechanical attachments and is easy to use and inexpensive to manufacture.

The buffing pad retainer comprises a truncated conical disk having a height no greater than the length of the bristles of the floor machine brush, and a major diameter approximately equal to the bore diameter of the annular brush. The conical disk has a depending cylindrical coaxial disk portion having a height no greater than the thickness of the buffing pad, and a diameter approximately equal to the bore diameter of the annular buffing pad.

In the preferred embodiment, the coaxial disk portion is made of buffing pad material. It is especially preferred to construct the entire retainer of buffing pad material.

DESCRIPTION OF THE PREFERRED EMBODIMENTS

Figure 1:
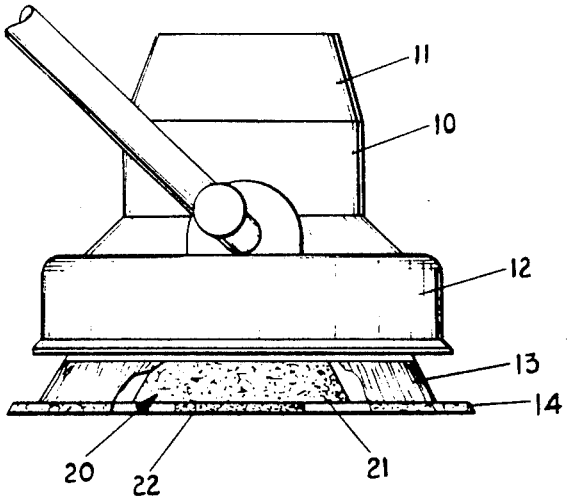
FIG. 1 is a side elevational view of a floor machine utilizing the buffing pad retainer of the present invention with a portion of the brush bristles removed to show the pad retainer.

Referring to the drawings is greater detail, FIG. 1 shows a conventional motorized floor machine which includes motor housing 11, brush housing 12 and annular brush 13. Floor machine 10 operates in a conventional manner. When the motor is actuated, brush 13 is rotated to perform scrubbing and cleaning operations.

As shown in FIG. 1, buffing pad 14 is interposed between the bottom of brush 13 and the floor. Buffing pad retainer 20 is shown in position to retain buffing pad 14 in operable engagement with annular brush 13 during the buffing operation.

Figure 2:
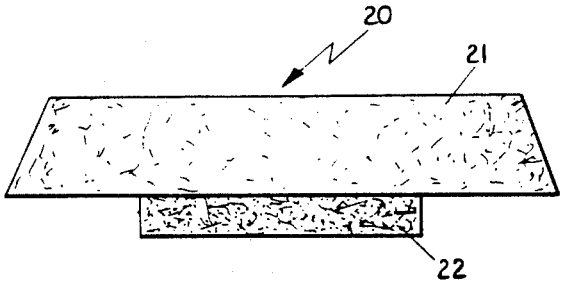
FIG. 2 is a side elevational view of the buffing pad retainer.
Figure 3:
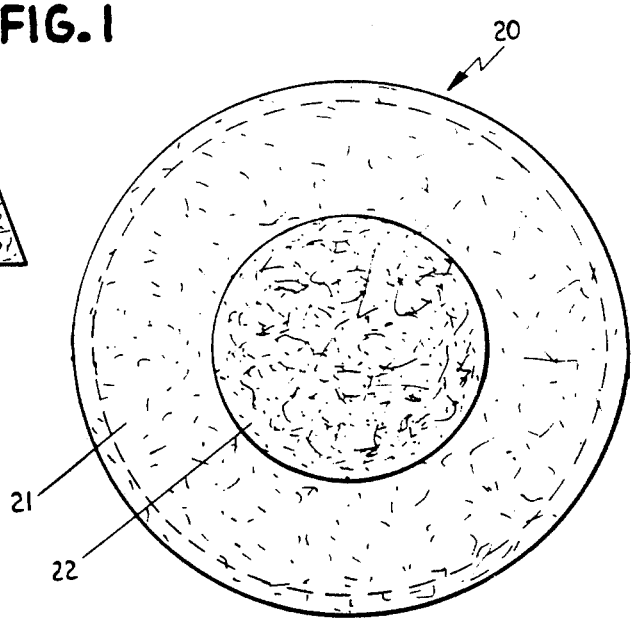
FIG. 3 is a bottom view of the buffing pad retainer.

The details of buffing pad retainer 20 are best shown in FIGS. 2 and 3. As shown, retainer 20 is a truncated conical disk member 21 having a depending cylindrical coaxial disk portion 22. The height of disk 21 should be no greater than the length of the bristles of brush 13. Preferably, the height of disk member 21 should have a major diameter approximately equal to the diameter of the annular bore of brush 13. Because of the truncated conical shape of disk 21, the tapered sides of disk 21 provide a lead for ease of positioning disk 21 in the annular bore of brush 13.

Disk 21 can be constructed of a wide variety of rigid or semi-rigid materials. For example, wood, metals and a wise variety of plastic materials can be used for disk 21. The preferred materials for disk 21 are expanded polystyrene foam, because it is light weight and inexpensive, and buffing pad material, when the entire retainer is to be made of buffing pad material as is shown in the embodiment depicted in FIG. 4.

Figure 4:
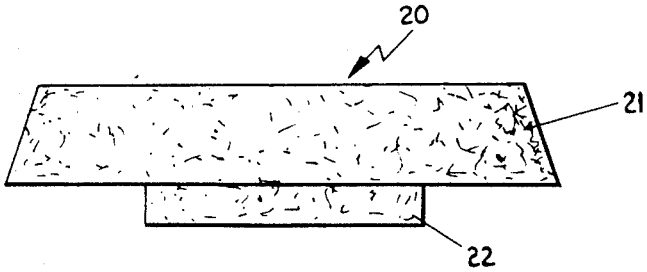
FIG. 4 is a side elevational view of a variation of the buffing pad retainer.

Depending disk 22 should have a diameter approximately equal to the bore diameter of the annular buffing pad 14 so as to engage buffing pad 14 as shown in FIG. 1. Also, the height of disk 22 should be no greater than the thickness of buffing pad 14. Disk 22 can be made of the same material as disk 21. However, when disk 22 has a height equal to the thickness of buffing pad 14, it will contact the floor during the buffing operation. Accordingly, in this instance, it is preferred that disk 22 be made of the buffing pad materials as is depicted in FIG. 4. However, if it is more economical to use different materials for disk 21 and disk 22, then disk 22 must be rigidly affixed to disk 21 by conventional means such as gluing, stapling or the like.

To use the buffing pad retainer of the present invention, buffing pad 14 is placed on the floor. Retainer 20 is then placed on top of buffing pad 14 with disk 22 fitting within the bore of the annular buffing pad 14. Floor machine 10 is then placed over retainer 20 and pad 14 so that disk 21 fits into the bore of annular brush 13. The buffing operation can then be commenced. The combination of the frictional forces between the lower ends of the bristles of the brush 13 on the top of pad 14, the contact between the sidewalls of disk 22 and pad 14, and the contact between the peripheral underside of disk 21 and the top of buffing pad 14 causes continuous rotation of buffing pad 14 when machine 10 is being operated. Because disk 21 is positioned in the bore of annular brush 13 and disk 22 is positioned in the bore of annular pad 14, buffing pad 14 will be centered at all times during the buffing operation. Thus, there is no possibility of buffing pad 14 becoming misaligned or being propelled away from the buffing machine.

The buffing pad retainer of the present invention is simple and inexpensive to construct and easy to use. It requires no complex and time consuming attachment means while insuring continuous positive engagement of the buffing pad with the floor machine during the buffing operation. When a pad is worn, it can be disposed of and quickly replaced with a new one without the need for tools or attachments of any kind.

Although preferred embodiments of the present invention have been described and illustrated, it will be obvious to those skilled in the art that various changes and modifications may be made without departing from the spirit of the present invention. Accordingly, the scope of the present invention is deemed to be limited only by the appended claims.

The embodiments of the present invention in which an exclusive property or privilege is claimed are defined as follows:

1. A buffing pad retainer for retaining an annular buffing pad in operable engagement with the bristles of a rotating annular floor machine brush comprising a truncated conical disk having a height no greater than the length of the bristles of said brush and a major diameter approximately equal to the bore diameter of said annular brush, said conical disk having a depending cylindrical coaxial disk portion having a diameter approximately equal to the bore diameter of said annular buffing pad and a height such that the disk portion extends into the bore in the pad but does not extend below the bottom of the pad when the retainer is mounted in a floor machine brush for buffing, the buffing pad retainer urging the buffing pad to rotate with the rotation of the floor machine brush while the pad remains flat on the floor over its entire surface, the cylindrical disk portion having a lower end formed of a material that does not damage the floor surface.

2. A buffing pad retainer according to claim 1 wherein said depending coaxial disk portion is made of buffing pad material and is shaped and positioned such that it assists in floor buffing.

3. A buffing pad retainer according to claim 2 wherein the entire retainer is made of buffing pad material.

4. A buffing pad retainer according to claim 1 wherein said conical disk is made of expanded polystyrene foam.

* * * * *